166-274 SR
FIP7912 XR 4,022,280

United States Patent [19]
Stoddard et al.
[11] 4,022,280
[45] May 10, 1977

[54] THERMAL RECOVERY OF HYDROCARBONS BY WASHING AN UNDERGROUND SAND

[76] Inventors: Xerxes T. Stoddard, 4617 W. 27th Ave., Denver, Colo. 80212; Ruel C. Terry, 3090 S. High St., Denver, Colo. 80210

[22] Filed: May 17, 1976
[21] Appl. No.: 686,995
[52] U.S. Cl. ..... 166/272; 166/306; 166/274
[51] Int. Cl.[2] ..... E21B 43/24; E21B 33/138
[58] Field of Search ..... 166/272, 268, 256, 259, 166/89, 303, 306, 312, 292; 175/65

[56] References Cited

UNITED STATES PATENTS

| | | | |
|---|---|---|---|
| 1,849,374 | 3/1932 | McEvoy, Jr. et al. | 166/89 |
| 3,498,381 | 3/1970 | Earlougher, Jr. | 166/303 |
| 3,687,197 | 8/1972 | Redford | 166/272 |
| 3,692,111 | 9/1972 | Breithaupt et al. | 166/272 X |
| 3,706,341 | 12/1972 | Redford | 166/272 X |
| 3,713,489 | 1/1973 | Fast et al. | 166/292 |
| 3,822,750 | 7/1974 | Ping | 166/312 X |
| 3,847,219 | 11/1974 | Wang et al. | 166/272 X |
| 3,854,531 | 12/1974 | Carlin | 166/272 |
| 3,921,733 | 11/1975 | Clampitt | 175/65 |
| 3,964,547 | 6/1976 | Hujsak et al. | 166/303 X |

*Primary Examiner*—Stephen J. Novosad
*Attorney, Agent, or Firm*—Ruel C. Terry

[57] ABSTRACT

Heat carrier fluid is circulated through an underground deposit of immobile petroleum. Circulation patterns are provided for more uniform heat transfer. Petroleum is made flowable and is recovered at the surface of the ground. Excessive underground channeling is controlled. Sand accumulations are removed from the well bore.

8 Claims, 2 Drawing Figures

THERMAL RECOVERY OF HYDROCARBONS BY WASHING AN UNDERGROUND SAND

BACKGROUND OF INVENTION

This invention relates to the circulation of a heat carrier fluid through an underground deposit of immobile petroleum, wherein the temperature of the deposit is increased so that the petroleum becomes flowable. Circulation patterns of the heat carrier fluid are controlled so that a washing action strips petroleum values from their locked positions. Petroleum valves are removed to an above ground location in part by mixing into the circulating carrier fluid, in part by displacement by the carrier fluid, and in part by the buoyancy of the petroleum values as compared to the heat carrier fluid. Flushing means are provided to control build up of sand accumulations in the well bore.

A considerable amount of attention has been directed in recent years to recovery methods for immobile petroleum. There are numerous major deposits of immobile petroleum known to exist in various parts of the world. These deposits are commonly referred to as tar sands, bitumen deposits, heavy oil deposits and the like. Generally, these deposits have common characteristics such as: the petroleum values have a pour point temperature well above the temperature of the deposit itself; petroleum values fill the available void space within the sand and thus reduce effective permeability to a value near zero; the host sand is unconsolidated and thus provides no effective matrix structure to support the overburden weight when the petroleum values are removed; and the like.

Methods have been developed for recovery of petroleum values in situ and above ground. An in situ method is described in copending application Ser. No. 671,259 of the present inventors, and an above ground method is described in U.S. Pat. No. 3,738,929 of Terry et al.

Particular attention is directed in the present invention to an immobile petroleum deposit that involves an unconsolidated sand. Generally, these deposits contain considerable more petroleum values per unit volume than do the conventional petroleum reservoirs that are located in porous host rock. It is not uncommon to find such a deposit wherein the sand has the appearance of being the intrusive material as compared to a conventional petroleum reservoir wherein the petroleum is the intrusive material that invaded the pore space of the host rock.

It is well known in the art that water preferentially wets rock or sand surfaces in comparison to liquid petroleum. It is not uncommon to find an immobile petroleum deposit in an unconsolidated sand wherein upon close inspection an individual sand grain is surrounded by a thin layer of water, which in turn is surrounded by a thicker layer of immobile petroleum. In these circumstances the sand grain serves as a core with an encasement of water which is further encased with a relatively thick rind of petroleum. Typically the rind of petroleum is at a temperature well below its pour point temperature and thus in effect is frozen in place.

Thus it may be seen that the petroleum values may be dislodged in situ by increasing the temperature of the petroleum to the point where it becomes a flowable liquid compared to its normal state of being a solid encasing rind. It is well known in the art that a petroleum substance can be converted readily from a solid material to a liquid material by the addition of modest amounts of heat, and that the liquid material can be made quite flowable by further additions of heat. Thus the fluidity of the petroleum material can be adjusted by the addition or removal of heat.

Upon drilling a well into an underground deposit of immobile petroleum as described above, little if any of the petroleum values may be recovered by flowing into the well bore. It is easy to envision that by adding heat, by whatever means, in the well bore that the petroleum values may be made flowable and therefore by gravity will flow into the well bore. In the case of an unconsolidated sand as described above, the material flowing into the well bore will include the sand grain core, the encasing water, and the mobilized petroleum matter. The sand grains, with a specific gravity of roughly twice that of water or liquid petroleum, will tend to sink to the bottom of the liquid column, and thus will begin the process of filling the well bore with sand particles, unless the well is equipped with a sand exclusion screen.

In a conventional petroleum reservoir located in competent host rock, the temperature of the reservoir is well above the pour point temperature of the petroleum, and the petroleum is thus readily flowable. Generally the pressure of the reservoir is well above the hydrostatic head pressure. Upon drilling a well into such a reservoir and in the absence of a plug (such as a column of drilling mud) the petroleum will readily flow into the well bore, and at times will flow all the way to the surface. Production may be continued as long as there are flowable fluids under the influence of differential pressure. As the differential pressure declines it is quite common to augment the natural reservoir pressure by injecting a fluid such as water to maintain the reservoir drive. In this manner petroleum is driven by displacement from higher pressure locations to the lower pressure area of the well bore. It is important that that the driving fluid water and the driven fluid petroleum move at essentially the same velocity for an effective sweep of the reservoir. Should the velocity of the driving fluid water significantly exceed the velocity of the driven fluid petroleum due to the difference of the mobility ratios of the two fluids, it is just a question of time until the driving fluid water breaks through to the production well. Upon water break through, the production of petroleum diminishes dramatically and the production of water greatly increases, and in the conventional sense the well is rapidly approaching economic depletion.

In the case of the immobile petroleum deposit, injection of a driving fluid has little effect on the mobility of the petroleum. In the prior art numerous schemes of adding heat to the driving fluid have resulted in failure when attempts were made to drive the petroleum mobilized by the heat to a nearby production well. In other cases the pressure of the hot driving fluid has been increased to a value sufficiently high to fracture the deposit and thus establish communication between the injection well and the production well. As long as this pressure is maintained, the communication passage remains open with large volumes of the driving fluid passing from the injection well, through the fracture, and to the production well. In this arrangement the driving fluid in effect becomes a circulating fluid that bypasses most of the petroleum adjacent to the established underground channel. Upon stopping injection with the attendant decrease in pressure, the unconsolidated nature of the deposit results in slumping into and closing of the communication passage, and termination of production. In some cases production attempts become unsuccessful because of excessive sand accumulations in the well bore of the production well.

It is an object of the present invention to disclose methods that permit continued injection of the heat carrier fluid into the deposit of immobile petroleum for the purposes of adding heat, mobilizing the petroleum, and capturing the petroleum at the surface of the earth. It is a further object of the present invention to disclose methods of controlling sand accumulations in the well bore. Other objects, capabilities and advantages of the present invention will become apparent as the description proceeds and with reference to the accompanying drawings.

SUMMARY OF THE INVENTION

Figure 1:
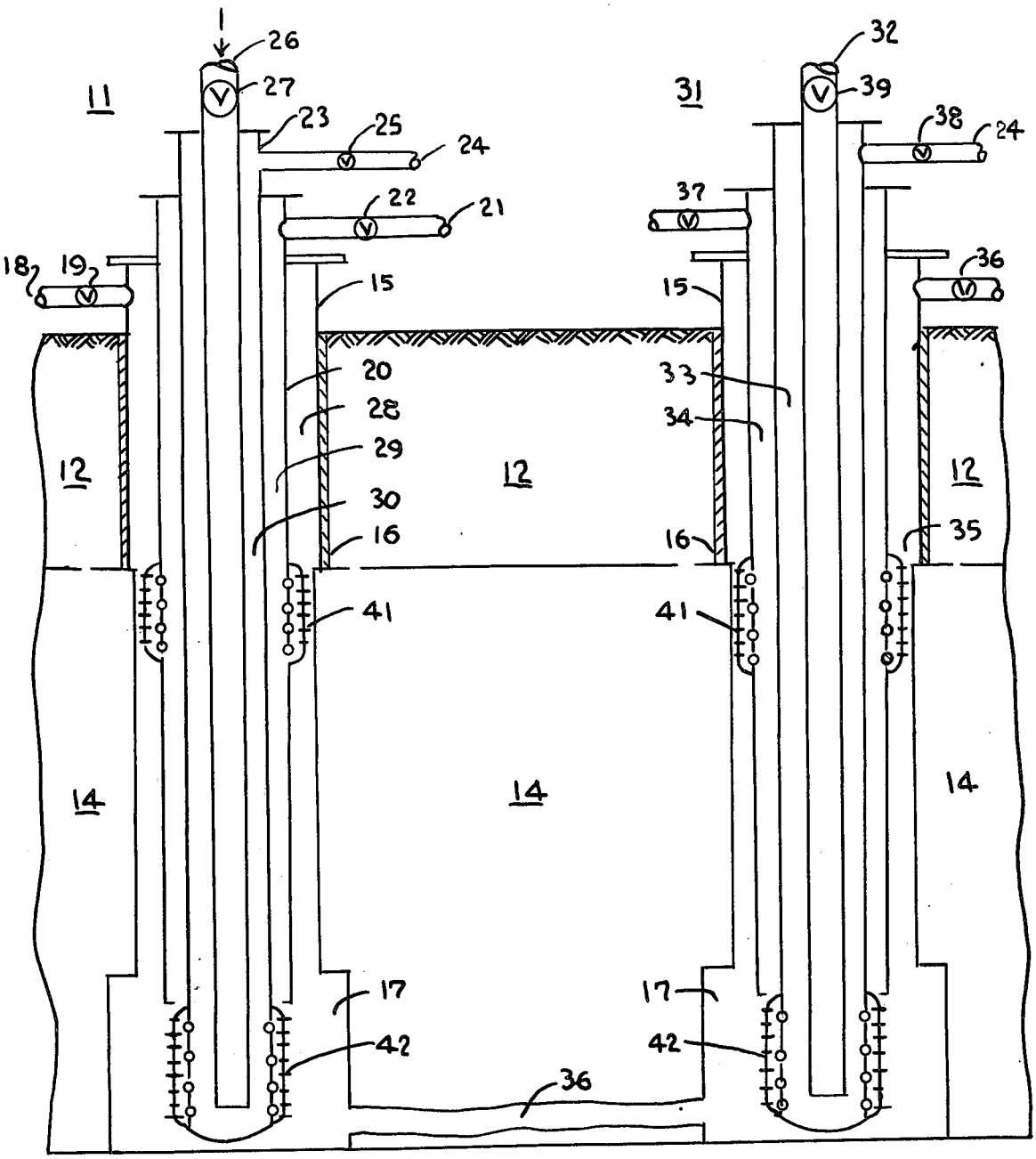
FIG. 1 is a diagrammatic vertical section taken through a portion of the earth showing the overburden, the underlying immobile petroleum deposit, and two wells that are equipped for the methods of the present invention.
Figure 2:
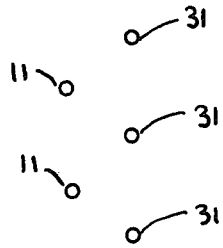
FIG. 2 is a plan view of a possible well pattern.

Referring to FIG. 1, two wells 11 and 31 are drilled from the surface of the earth through the overburden 12 to the top of the immobile petroleum deposit 14. Protective casing 15 for example 13 inches in diameter is set in the well bore and cemented 16 to the surface to provide a hermetic seal. The wells are then deepened to the lowermost portion of the petroleum deposit and are underreamed 17 in the lower portion of the deposit to a diameter for example of 16 inches.

Protective casing 15 has connected to it in an above ground location flow line 18 containing valve 19. Within casing 15 of well 11 there are installed three strings of concentric pipes. The outer pipe or liner 20 which could be for example 9 inches in diameter is suspended open ended to a point near the bottom of the underreamed hole 17. Attached to liner 20 is flow line 21 containing valve 22.

Within liner 20 is pipe 23 which could be for example 6 inches in diameter and is suspended to a point near the bottom of underreamed hole 17 and preferably at least 2 feet below the lowermost point of liner 20, and contains perforations 42 to permit flow of fluids and to exclude free passage of sand particles. Attached to pipe 23 is flow line 24 containing valve 25.

Within pipe 23 is tubing 25 which could be for example 3 inches in diameter and is suspended to a point near the bottom of pipe 23. Tubing 26 contains valve 27.

This arrangement within well 11 permits the control of flow of fluids through flow line 18 into annulus 28, through flow line 21 into annulus 29, through flow line 24 into annulus 30, and through tubing 26. It is therefore apparent that fluids may be injected into or withdrawn from the well bore of well 11 through the communication passages in tubing 26, annulus 30, annulus 29 and annulus 28.

Likewise well 31 is similarly equipped so that fluids may be injected into or withdrawn from the well bore of well 31 through the communication passages in tubing 32, annulus 33, annulus 34, and annulus 35. The flow of fluids are controlled by valve 36 in annulus 35, valve 37 in annulus 34, valve 38 in annulus 33 and valve 39 in tubing 32.

For purposes of illustration the overburden 12 could be 200 feet thick and in the ideal case would be composed of impervious rocks such as a competent shale formation. The immobile hydrocarbon formation 14 could be 100 feet thick and preferably would be an unconsolidated sand impregnated with petroleum values that have a pour point temperature for example of 100° F. The temperature of the immobile petroleum deposit 14 could be for example in the order of 60° F.

Wells 11 and 31 equipped as shown in FIG. 1 are hermetically sealed between the surface of the ground and petroleum deposit 14. The well bores of wells 11 and 31 will be competent with sufficient structural strength to prevent caving of petroleum deposit 14 into the well bores as long as the temperature of the petroleum values remains well below the pour point temperature. In this mode with all valves closed, fracture 36 may be created by opening valves 27 and 39 and injecting fluid into tubing 26 at a pressure for example of 350 psia, with pressure relief provided by tubing 32 to the surface of the ground. When communication is established between wells 11 and 31 through fracture 36 in formation 14, communication may be maintained by continuing fluid injection through tubing 26 and holding proper back pressure by adjusting valve 39. The complete system may be stabilized by continuing injection of fluid, for example water at a temperature of 60° F, into tubing 26, holding back pressure on valve 39, then opening each additional valve in turn until each communication passage is completely filled with water, which at a surface location might have a pressure of 200 psia and in fracture passage might measure 350 psia. Once the complete system is full of fluid, for example water, the system can be made to remain pressurized, for example 350 psia in fracture passage 36, by injecting a small amount of water through tubing 26 with valve 27 open and all other valves closed. The amount of water being injected would equal the amount of water slowly migrating through formation 14 within the available permeability of formation 14. In some cases the amount of makeup water can be as low as five gallons per minute once the pressure becomes stabilized. It is important that the planned system pressure, for example 350 psia in fracture 36 be maintained so that formation 14 is prevented from slumping into fracture 36 and destroying the communication passage between wells 11 and 31 through formation 14.

With the system full of fluid, for example water, it is easy to envision numerous circulation patterns for the movement of fluids within well 11, within well 31, and between wells 11 and 31.

In support of production wells 11 and 31 certain surface facilities (not shown) are required. These surface facilities are similar to those used in Frasch process sulfur mining and in conventional petroleum production. Included are a source of process water, pumps to move the water under appropriate pressure, water treating facilities, water heating facilities, mud preparation and injection facilities, separator facilities to separate water from petroleum and to remove sand from produced fluids, and the like. Appropriate connections are made between the flow line of wells 11 and 31 and the surface facilities.

With these arrangements a heat carrier fluid may be caused to flow from the surface of the earth, through an injection passage, through petroleum deposit 14, with produced fluids withdrawn to the surface of the earth through a removal passage. With transfer of heat from the heat carrier fluid to the cooler petroleum deposit, underground temperatures may be increased sufficiently to cause the petroleum values to become freely flowable. By continuing the circulation of the heat carrier fluid, more and more of the petroleum values can be made flowable and therefore subject to movement and ultimate capture at the surface.

In this mode the present invention permits actuation and maintenance of several mechanisms underground. These include the continual addition of heat by the circulating heat carrier fluid, temperature rises in ever increasing increments of the petroleum formation, causing the petroleum to change from its immobile state to a free flowing mobile state, freeing the entrapped connate water, freeing the entrapped sand grains, flushing the mobilized petroleum by the action of the circulating heat carrier fluid, continuously washing the sand grains so that water can preferentially wet the sand grain surfaces to the exclusion of petroleum tending to adhere to the sand grain surfaces, freeing the petroleum so that it may naturally coalesce, providing a liquid medium so that coalesced petroleum may naturally agglomerate, providing a vertical liquid column so that agglomerated petroleum (with its lesser bulk density compared to water) may naturally rise to the top of the liquid column and thus may be withdrawn at the surface, and the like. Further the freed sand grains that may tend to collect and fill the well bore, may be easily removed by the simple expedient of flushing the sand out of the well bore under the influence of rapidly moving water injected in one communication passage and removed through an adjacent or nearby removal passage.

Thus it may be seen that the present invention provides numerous improvements over the prior art both for above ground techniques and underground techniques. Improvements over prior above ground techniques include elimination of overburden removal and backfill, elimination of complex flow processes, elimination of tailings disposal problems, elimination of costly processing plants, and the like. Improvements over prior underground techniques include additional choices for the flow paths of fluids, more uniform transfer of heat, methods of closing enlarged underground channels, simplified methods of controlling sand accumulations, and the like.

DESCRIPTION OF THE PREFERRED EMBODIMENT

The process begins by filling all underground circuits with water as described in the Summary of the Invention above. Valve 27 is opened and process water is injected through tubing 26 into the well bore of well 11 through fracture 36, into the well bore of Well 31, and on to the surface via tubing 32 with valve 39 opened to the extent necessary to keep proper back pressure on the system, for example 350 psia in fracture 36. Injected process water is at elevated temperature, for example 330° F at valve 27. Return water through tubing 32 will initially have a temperature of for example 60° F, with the temperature slowly increasing as the circuit comes up to temperature stabilization. Upon temperature stabilization the return water will reach a reasonably constant temperature at valve 39, for example in the order of 200° F.

Initial injection volume of the hot process water should be what the circuit is capable of receiving without danger of building up underground pressures to the point of ruptures through overburden 12 to the surface, for example an injection rate of 100 gallons per minute. As a practical matter return water will be saved at the surface for recycling through the system. Should the temperature of the return water increase to a point above 200° F, injection water temperature should be lowered to the extent necessary to keep the return water temperature below its boiling point temperature at atmospheric pressure.

Circulation of hot process water is continued for a period of time, for example 24 hours, with injection temperature of for example 330° F and an injection rate of for example 100 gallons per minute. With the heat losses from the hot process water to the circulation system, metal parts will absorb heat and expand, the portion of formation 14 exposed to the well bores will absorb heat as will the portion of the formation 14 exposed to fracture passage 36.

With the circulation pattern established the petroleum values subjected to heat will gradually increase in temperature and, at the pour point temperature of the petroleum, will become flowable. Further absorption of heat will cause the petroleum values nearest the heat source to become readily flowable. Each unit of petroleum thus affected will release the encased water, release the core sand grain and the petroleum will coalesce unto itself in a multiplicity of droplets. A portion of the petroleum droplets, being buoyant compared to water, will migrate upward to the highest permeable point in the water, column where the petroleum will agglomerate and displace water in the column, for example in annulus 29. The petroleum will migrate into annulus 29 through sand exclusion screen 41 which may be of the type commonly used in oil field practice. Petroleum may then be recovered through flow line 21 by opening valve 22 to the extent necessary to permit flow of petroleum at a rate consistent with its accumulation rate within annulus 29. In some cases this rate of withdrawal can be as high as 10 barrels per hour. Other portions of the petroleum droplets will be swept with the circulating water and will arrive at the surface through tubing 32. In some cases the petroleum swept with circulating water can be as much as 20 barrels per hour as measured at the above ground separator where the petroleum is removed from the water.

The sand grains formerly serving as a core are now free to migrate. A portion of these sand grains will settle to the bottom of Well 11, a portion will be swept along fracture passage 36 into the bottom of Well 31, and a portion from the underreamed portion 17 of Well 31 will settle to the bottom of Well 31. By far, the largest accumulation of sand will be located in the bottom portion of Well 31.

After initial injection period of 24 hours, injection is terminated in tubing 26 and begun in the reverse direction through tubing 32 into well bore 17 of Well 31, through fracture passage 36, into well 11 on the surface via tubing 26. The fracture passge 36 will have enlarged considerably due to the removal of mobilized petroleum and the freeing of entrapped sand. At this point in the production cycle, injection rate of the hot process water may be increased to for example 200 gallons per minute for the next injection period, for example 24 hours. A portion of the sand build-up in the bottom of Well 31 will be transported by the circulating water to the bottom of well 11.

With the continuation of circulation of hot process water, the capacity of fracture passages 36 to take water will be increased. An additional volume of injected process water may be added by injecting hot process water through annulus 33 so that the combined injection rate through tubing 32 and annulus 33 is for example 420 gallons per minute. Return fluids may be directed to the surface via tubing 26 and annulus 30 to surface facilities where produced fluids are de-sanded, and the petroleum is separated from the water. A substantial amount of sand is prevented from accompanying the return fluids to the surface by the perforations and sand exclusion screen 42 which preferably are of the type commonly used in high volume water wells.

Periodically it will be necessary to remove the accumulation of sand from the lower portion of the production wells. If it is desired to remove the accumulated sand from well 11, for example, all valves in the system can be closed to maintain a proper pressure in fracture passage 36, for example 350 psia, to prevent the slumping of formation 14. Then injection of hot process water may be begun through tubing 26 by opening valve 27 with an injection pressure such that the water pressure at the lower end of tubing 26 would be, for example, 400 pisa; then opening valve 22 so that flushing circulation will be through tubing 26 into the well bore and back to the surface via annulus 29. The injection pressure should be adjusted so that the velocity of the circulating water is sufficient to transport entrained sand to the surface. A short period of flushing circulation, for example 5 minutes, will substantially free the bottom of the well bore of accumulated sand, at which time the normal injection and withdrawal circulation pattern may be restored.

The process continues by injecting hot water into well 11 and withdrawing fluids through well 31 for a period of time, then reversing the flow by injecting into well 31 and withdrawing fluids through well 11 for a period of time, while building up the injection rates to the planned maximum level. At maturity in the life of the wells the injection cycle in one direction could be, for example, shortened to four hours, and the maximum planned injection rate could be, for example, 420 gallons per minute. By injecting the hot process water in one direction for a period of time, then reversing the flow for a period of time, the reservoir sand receives a thorough flushing and washing and thus will give up a substantial portion of the entrained petroleum. In some cases it may be desirable to adjust the pH of the process water to level above pH 7 to facilitate the washing action underground, and in some cases it may be desirable to include an additive to the hot process water that serves to reduce the surface tension of the water to further facilitate the flushing and washing action underground.

It will be apparent to those skilled in the art that fracture channel 36 may, after extensive circulation of fluids, become so enlarged as to form a conduit that results in poor transfer of heat to the surrounding portion of formation 14. If such a condition occurs the recovery of petroleum values may diminish to the point of becoming unsatisfactory in the commercial sense. Remedial action may be applied by mudding off the open conduit.

To apply remedial action a mud is mixed at the surface, for example using native clay, so that a slush mud slurry is formed containing for example in the range of 30 to 40% solids. The slush mud slurry preferably is heated to process temperature, for example 330° F, under pressure for injection into the system. The standard process at this time, for example, may call for injection of hot process water into well 11 through tubing 26 and annulus 30 at a combined rate of 420 gallons per minute with fluid withdrawals through well 31 via tubing 32 and annulus 33. Injection in annulus 30 could be terminated by closing valve 24 and water injection in tubing 26 could be reduced, for example to 200 gallons per minute, while at the same time injecting the mud slurry into annulus 29 at a rate of, for example, 200 gallons per minute. At these injection rates the velocity of the fluids is sufficient to maintain the entrained solids in the fluid. Once the slush mud slurry encounters the enlarged underground channel 36, velocity of the fluid is substantially reduced and the suspended solids settle out and are deposited in channel 36. In time channel 36 can be plugged in this manner. The mud slurry injection may be continued until it is necessary to increase the mud slurry injection pressure in order to sustain the mud slurry injection rate. The buildup in required mud slurry injection pressure signals that the open conduit 36 is becoming plugged with mud. Mud slurry injection is then terminated and injection of hot process water is resumed with injection rates first at lower level, for example 200 gallons per minute and gradually increasing as an alternate flow channels are established through formation 14.

It is desirable that injections of hot mud slurry be made periodically, in order to control the size of underground channels and to provide fill material to minimize subsidence of the overburden 12. It is also desirable to flush the accumulated sand in the well bore periodically to prevent excessive sand buildups that impede the free flow of circulating fluids.

With the operating pressures required underground it is important that an effective hermetic seal be maintained between formation 14 and the surface of the ground. With thermal expansion of the metal parts, particularly the protective casing 15, appropriate steps must be taken to maintain the hermetic seal. Tubing 26, pipe 23 and liner 20 may be suspended in a manner that their elongation may occur without restraint in the well bore. Protective casing 15 must be protected from the thermal area to the extent that its elongation is restricted to a level below that which would break the seal established by the sealant 16. It is preferred that the temperature of casing 15 be controlled by injecting a petroleum gel, oil base mud or similar material substantially filling annulus 23 to a lowermost point near the top of formation 14. This petroleum gel may be circulated by injecting the gel through an injection line (not shown) located in annulus 28 with the injection release point near the bottom of the gel column, with gel removed for cooling through flow line 18. The coolant material should have a specific gravity less than 1 and preferably 0.8.

Thus it may be seen that a deposit of immobile petroleum may be heated in a progressively uniform manner by transferring heat from a circulative heat carrier fluid, that the petroleum thus heated may be made flowable and transported to the surface for capture, that the accumulations of formation sand may be flushed from the well bore, that excessive underground channels may be plugged with mud, that subsidence may be minimized and that the hermetic seal of the system may be maintained during the production phase. While the present invention has been described with a certain degree of particularity, it is understood that the present disclosure has been by way of example and that changes in details of the processes may be made without departing from the spirit thereof.

What is claimed is:

1. A method of mobilizing and producing an immobile petroleum located in an underground formation comprising the steps of drilling two or more wells from the surface of the earth into an immobile petroleum deposit, establishing a hermetic seal in each of said wells between the underground petroleum deposit and the surface of the earth, establishing four communication passages in each well between the surface of the earth and the underground petroleum deposit, the first communication passage of the said four communication passages being the annulus between a casing and a liner set within the said casing, the second communication passage of the said four communication passages being the annulus between the said liner and a pipe set within the said liner, the third communication passage of the said four communication passages being the annulus between the said pipe and a tubing set within the said pipe, the fourth communication passage of the said four communication passages being the communication passage within the said tubing, establishing a communication passage between each of the said wells through the underground petroleum deposit, circulating a heat carrier fluid from the surface of the ground through the said fourth and third communication passages in the first well, through the underground petroleum deposit, withdrawing the circulating heat carrier fluid and flowable petroleum through one or more communication passages in the second well, and withdrawing the flowable petroleum through the said second communication passage in the said first well, circulating a coolant fluid within the said first communication passage of the said first well, the said coolant fluid being at a temperature less than the temperature of the said heat carrier fluid, and the said coolant fluid being of a lower specific gravity than the said heat carrier fluid, and capturing and saving the petroleum at the surface of the ground.

2. The method of claim 1 further including the steps of terminating the injection of the said heat carrier fluid into the said third communication passage in the said first well and injecting a mud slurry through the said third communication passage in the said first well, the said mud slurry being further injected into the said underground communication passage between the said first well and the said second well.

3. The method of claim 1 wherein circulation of the said heat carrier fluid is terminated in the said fourth and third communication passages in the said first well, wherein withdrawals of the said flowable petroleum and the said circulating heat carrier fluid are terminated from the said second well, wherein withdrawal of the said flowable petroleum is terminated in the said first well, and further including the step wherein flushing fluid is injected in the said fourth communication passage in the said second well and is withdrawn through an adjacent communication passage in the said second well, said flushing fluid being at a pressure greater than the fluid pressure in the said underground petroleum deposit, flushing the accumulated sand from the well bore of the said second well and transporting the sand to the surface for removal.

4. The method of claim 1 wherein the heat carrier fluid is water.

5. The method of claim 4 wherein the injection temperature of the heat carrier fluid is at least 100° F above the temperature of the underground petroleum deposit.

6. The method of claim 1 wherein the heat carrier fluid pressure exceeds the hydrostatic head pressure.

7. The method of claim 1 wherein the pH value of the heat carrier fluid exceeds 7.

8. The method of claim 1 wherein an additive is blended with the heat carrier fluid, said additive having the capability of reducing the surface tension of the fluid.

* * * * *